US011806569B2

(12) United States Patent
Markowski

(10) Patent No.: US 11,806,569 B2
(45) Date of Patent: Nov. 7, 2023

(54) FITNESS SYSTEM

(71) Applicant: Jedi Markowski, Berlin, NJ (US)

(72) Inventor: Jedi Markowski, Berlin, NJ (US)

( * ) Notice: Subject to any disclaimer, the term of this patent is extended or adjusted under 35 U.S.C. 154(b) by 0 days.

(21) Appl. No.: 17/399,610

(22) Filed: Aug. 11, 2021

(65) Prior Publication Data

US 2022/0062690 A1 Mar. 3, 2022

Related U.S. Application Data

(60) Provisional application No. 63/064,143, filed on Aug. 11, 2020.

(51) Int. Cl.
*A63B 21/16* (2006.01)
*A63B 23/12* (2006.01)
*A63B 23/035* (2006.01)

(52) U.S. Cl.
CPC .... *A63B 21/1627* (2013.01); *A63B 23/03516* (2013.01); *A63B 23/1218* (2013.01)

(58) Field of Classification Search
CPC .. A63B 21/1618–1663; A63B 1/00–04; A63B 23/1218; A63B 21/1627
See application file for complete search history.

(56) References Cited

U.S. PATENT DOCUMENTS 829,653 A * 8/1906 Kercher ..... A63B 1/00 482/40
1,752,683 A * 4/1930 Meagher ..... A24B 1/08 248/251
1,774,224 A * 8/1930 Sam ..... A63B 17/00 482/24
3,342,484 A * 9/1967 Christensen ..... A63B 1/005 482/40
4,077,403 A * 3/1978 Steele ..... A63B 7/02 482/37
4,657,242 A * 4/1987 Guridi ..... F16B 7/22 482/40
4,772,011 A * 9/1988 Guridi ..... A63B 21/1627 482/40
5,180,350 A * 1/1993 Thomas ..... A63B 1/00 482/40
5,240,460 A * 8/1993 Tighe ..... A63G 21/00 248/200.1
6,017,293 A * 1/2000 Pfefferle ..... A63B 21/1627 482/40
6,267,711 B1 * 7/2001 Hinds ..... A63B 21/1663 482/904
7,108,636 B1 * 9/2006 Garcia ..... A63B 21/1627 482/141
9,072,940 B1 * 7/2015 Gutierrez ..... A63B 23/1218
(Continued)

*Primary Examiner* — Nyca T Nguyen
(74) *Attorney, Agent, or Firm* — CONDO ROCCIA KOPTIW LLP

(57) ABSTRACT

A fitness system may be attachable to a doorway. The fitness system may include a bar, a first vertical track, and a second vertical track. The vertical tracks may be attached to opposite door jambs of a doorway. The first vertical track may have with receptacles for receiving a first end of the bar. The second vertical track may have receptacles for receiving a second end of the bar. When the bar is inserted into the receptacle on the first vertical track and the corresponding receptacle on the second vertical track the bar is parallel to the floor, suitable, for example, for supporting fitness activity.

4 Claims, 8 Drawing Sheets

(56) References Cited

U.S. PATENT DOCUMENTS

| | | | | |
|---|---|---|---|---|
| 9,427,612 | B1 * | 8/2016 | Swanson | A63B 21/16 |
| 2009/0111661 | A1 * | 4/2009 | Hauser | A63B 23/1209 482/40 |
| 2014/0106948 | A1 * | 4/2014 | Agostini | A63B 21/169 482/129 |
| 2018/0021626 | A1 * | 1/2018 | Kilmon | A63B 21/4049 482/23 |
| 2021/0316182 | A1 * | 10/2021 | Kendall | A63B 21/1636 |

* cited by examiner

FITNESS SYSTEM

CROSS REFERENCE TO RELATED APPLICATION

This application claims priority to and the full benefit of U.S. Provisional Application 63/064,143 titled "Fitness systems," filed Aug. 11, 2020, which is hereby incorporated by reference in its entirety.

TECHNICAL FIELD

Aspects of the present invention are directed to a fitness system, and, in particular, a fitness system that can be attached within a doorway.

BACKGROUND

Over the past several decades, at home fitness has become a major industry and has enabled people from all walks of life to become more physically fit and healthy. At-home fitness is preferred by many individuals because it allows for exercise at their own pace, during times that work for them and in the privacy of their own home. Types of at-home fitness programs have traditionally included weight training, aerobic exercise, or combinations thereof, to name a few. For programs such as weight training and gymnastics, often large equipment is necessary, requiring large rooms to store the equipment or the necessity to "break down" the equipment after each use. For example, to perform a traditional pull-ups or chin-ups a stationary bar is often attached to a larger fitness system. Alternatively, an unsightly bar can be attached to a wall or a ceiling. In recent years, "portable" pull-up bars have been designed that can be attached above a doorway. The portable bar rests on the wall above the door and the doorway trim. These "portable" pull-up bars, although useful for performing pull-ups do have their drawbacks. For example, in some instances, the system could do damage to the door trim, the height of the system is not adjustable, the system needs to be removed after the exercises are complete for the door to become fully functional, and the system is limited strictly to performing pull-ups or chin-ups. A fitness system that reduces or eliminates these issues would be highly desirable.

SUMMARY

Aspects of the present invention are directed to a fitness system that is designed to be attachable to a doorway. The fitness system includes a bar, a first vertical track with receptacles for receiving a first end of the bar and a second vertical track with receptacles for receiving a second end of the bar. The vertical tracks may be attached to opposite door jambs of a doorway so that when the bar is inserted into the receptacle on the first vertical track and the corresponding receptacle on the second vertical track the bar is parallel to the floor.

DETAILED DESCRIPTION

Aspects of the present invention are directed to a fitness system that is designed to be attachable to a doorway. The fitness system includes a bar, a first vertical track with receptacles for receiving a first end of the bar and a second vertical track with receptacles for receiving a second end of the bar. The vertical tracks may be attached to opposite door jambs of a doorway so that when the bar is inserted into the receptacle on the first vertical track and the corresponding receptacle on the second vertical track the bar is parallel to the floor.

The modular fitness system of the present invention overcomes many of the issues associated with traditional "portable" pull-up bars. First, this system is attached to the door jamb which is sturdier than the trim above a doorway, on which traditional pull-up bars are attached. Second, systems of the present invention allow for adjusting the height of the bar depending on the height or needs of the user. Third, when the bar is removed from the system, the tracks can remain in the doorway without impacting the operability of the doorway or the door. Finally, the present doorway fitness system may be extended to several other disciplines beyond pull-ups and chin-ups. For example, the bar may be used for exercises related to gymnastics, barre, Parkour, ninja, calisthenics, and dance, among others.

Figure 1:
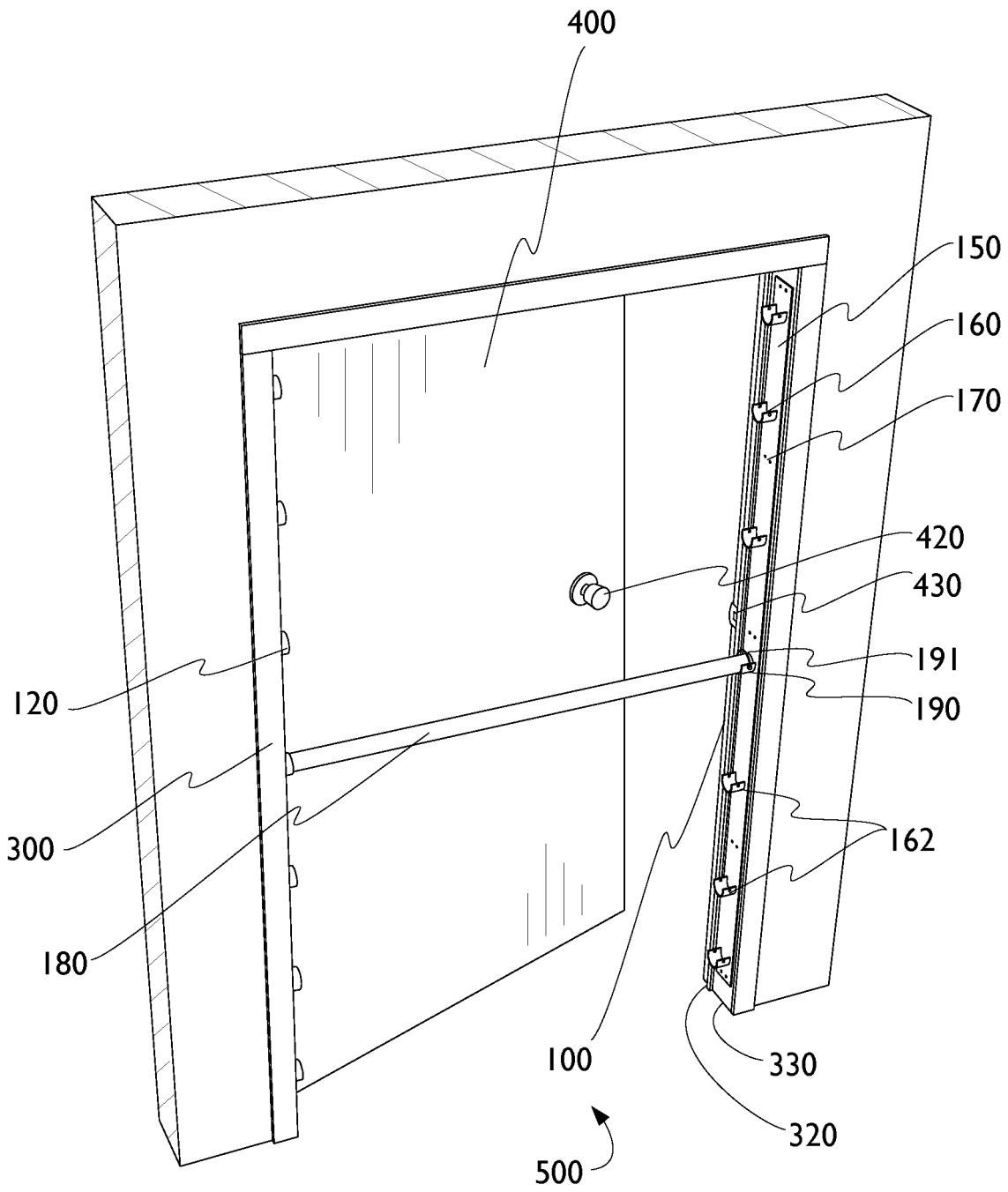
FIG. 1 shows a perspective view of a doorway fitness system positioned in a doorway.
Figure 2:
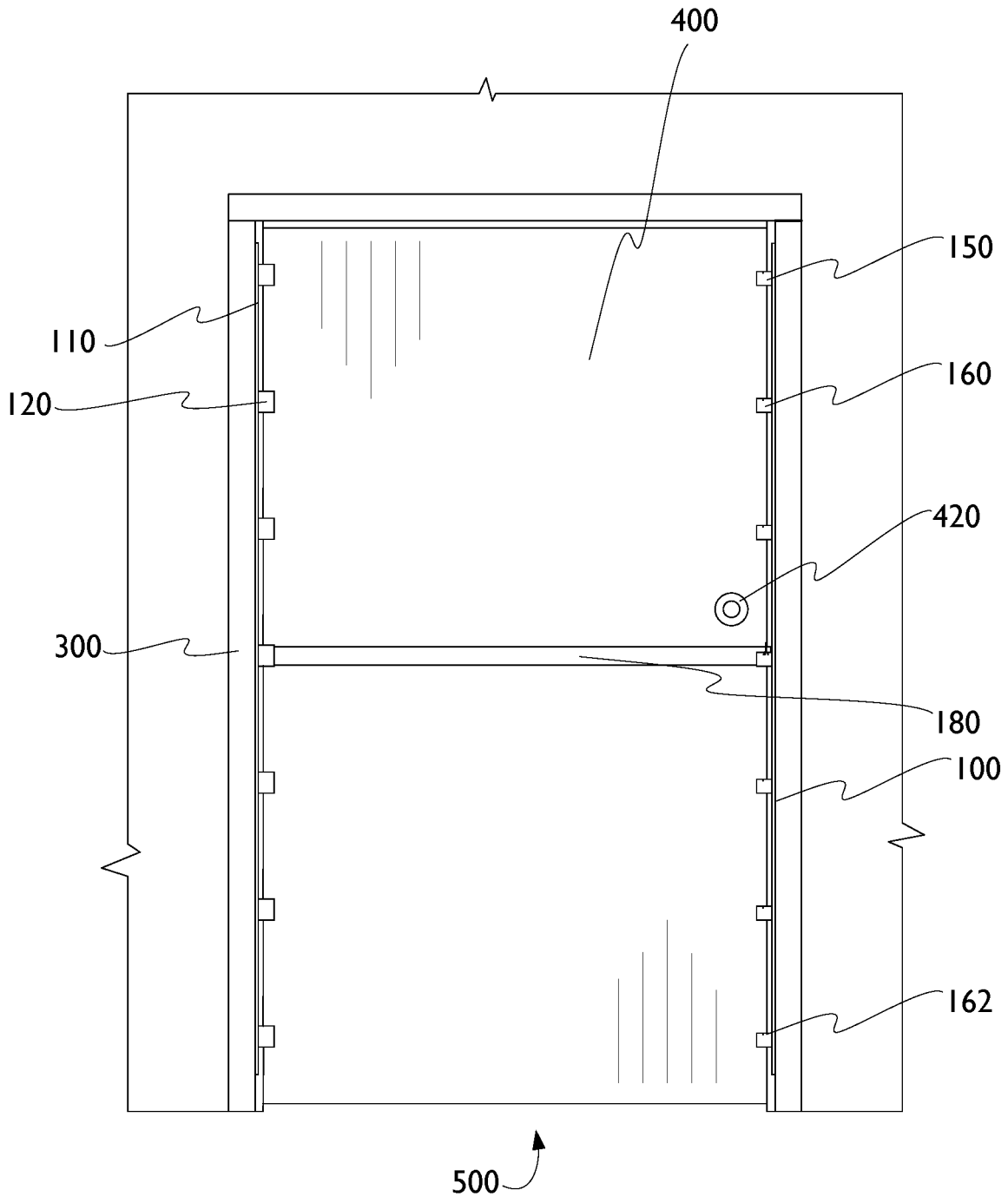
FIG. 2 shows a front view of a doorway fitness system positioned in a doorway.
Figure 3:
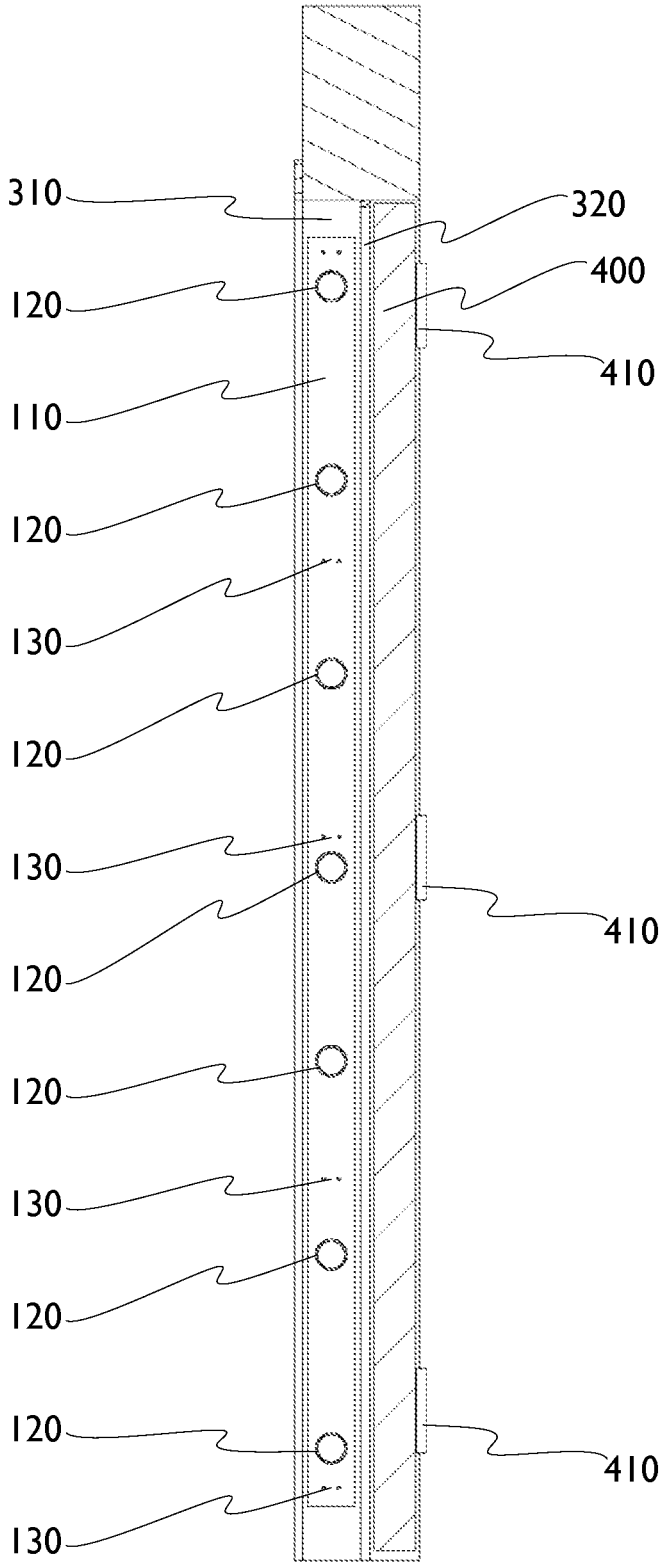
FIG. 3 shows a side view of a first track of a doorway fitness system attached to a door jamb.
Figure 4:
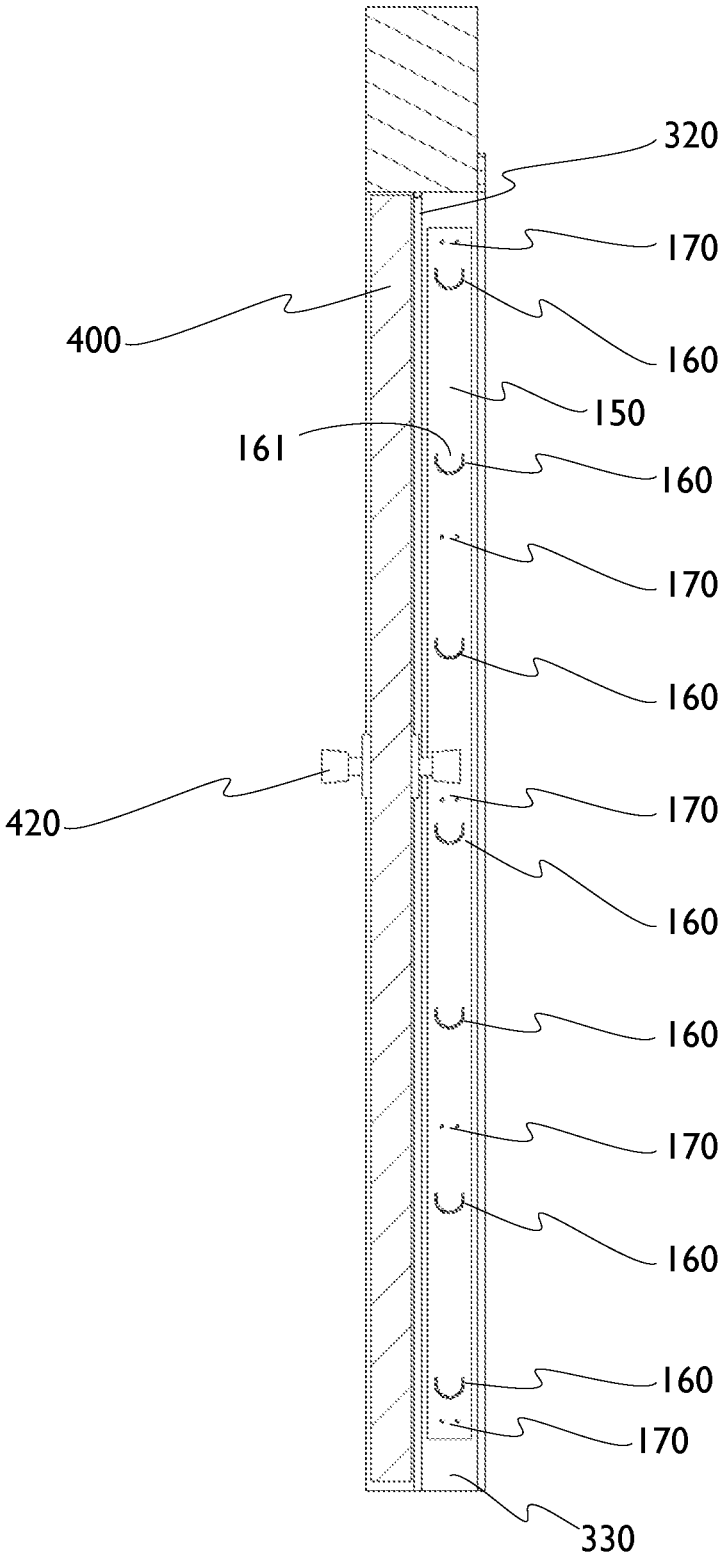
FIG. 4 shows a side view of a second track of a doorway fitness system attached to a door jamb.
Figure 5:
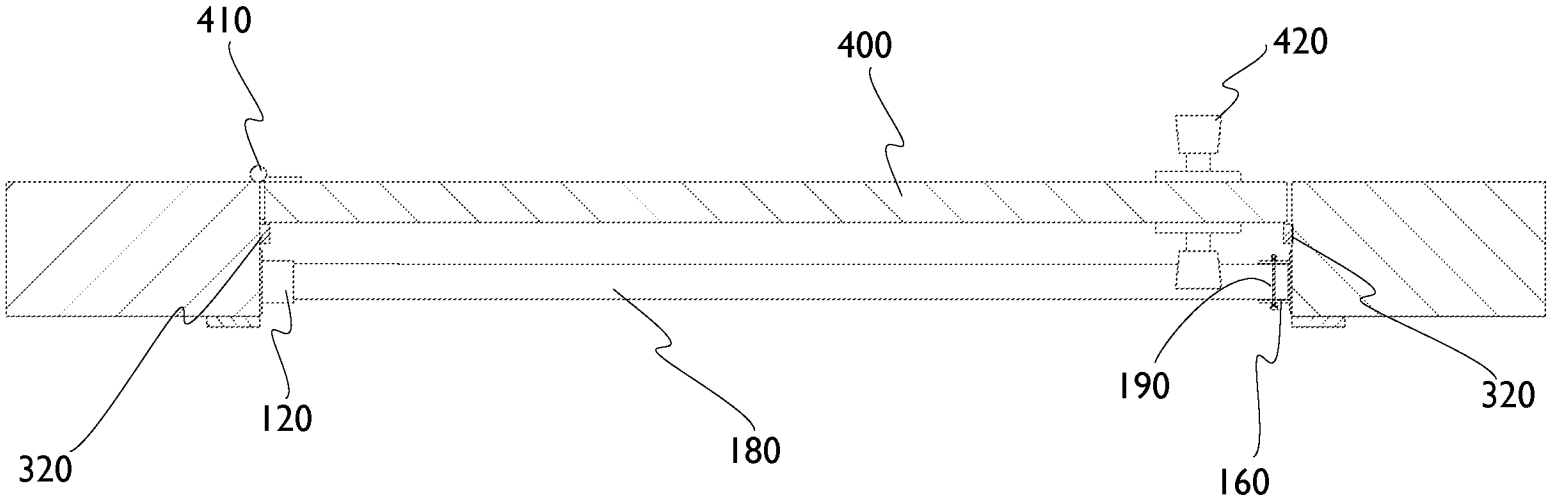
FIG. 5 shows a top view of a doorway fitness system positioned in a doorway.
Figure 6:
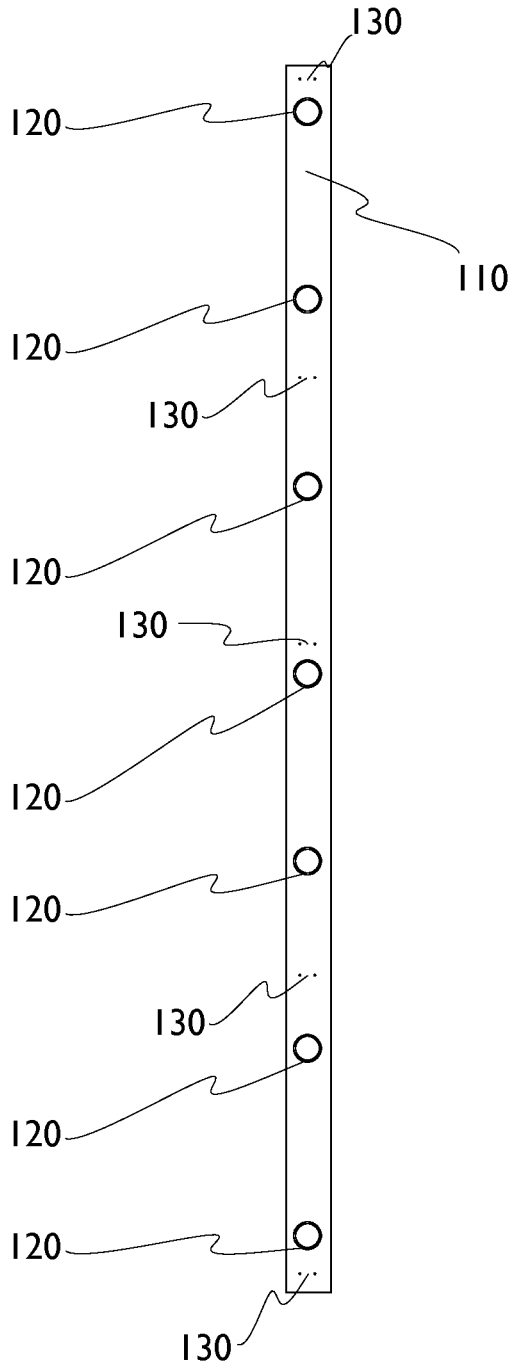
FIG. 6 shows a side view of a first track of a doorway fitness system.
Figure 7:
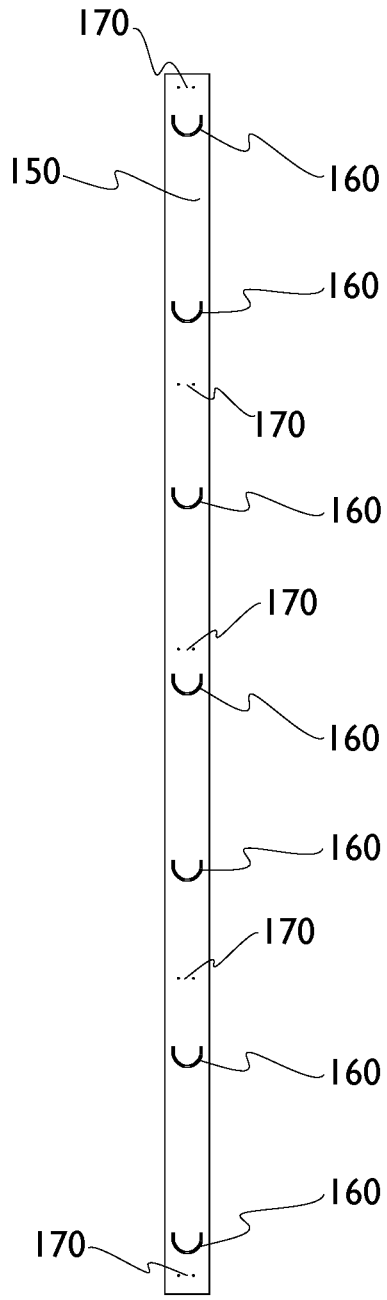
FIG. 7 shows a side view of a second track of a doorway fitness system.
Figure 8:
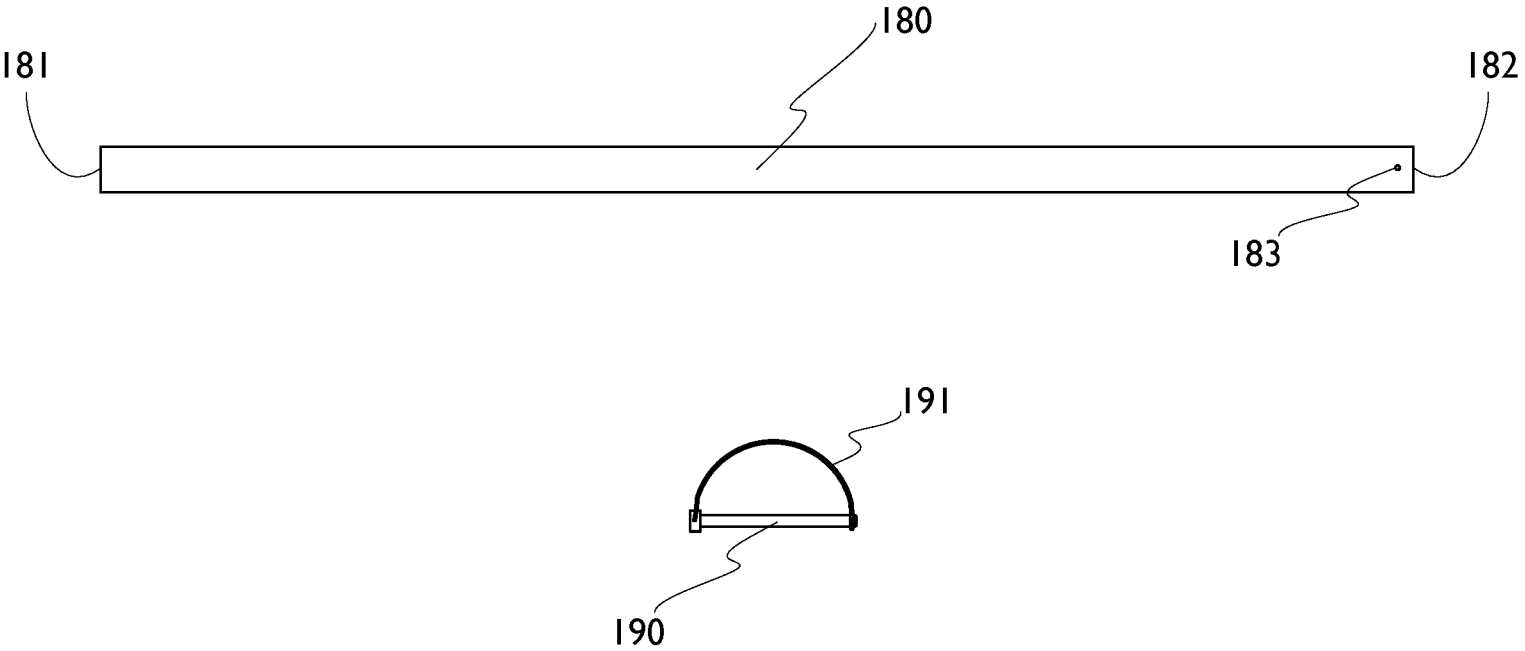
FIG. 8 shows a bar and a pin of a doorway fitness system.

FIG. 1 shows a perspective view of a fitness system 100 positioned in a doorway 300. Fitness system 100 is positioned in doorway 300 such that door 400 can open and close while fitness system 100 is in place. First vertical track 110 is attached to door jamb 310 on the opposite side doorstop 320 from door hinges 410 and door latch 430. First vertical track includes seven first vertical track receptacles 120 evenly distributed along the first vertical track for receiving a first end 181 of bar 180. First vertical track receptacles 120 are in the shape of a full circle with an inner diameter equal to or slightly less than the diameter of bar 180 so that first end 181 of bar 180 can fit within first vertical track receptacle 120. First vertical track 110 also includes five fastening locations 130 so that first vertical track 110 can be secured to door jamb 310. First vertical track 110 may be secured to door jamb 310 using fasteners known to one skilled in the art such as screws, nails, bolts, or plugs, among others.

Second vertical track 150 is attached to door jamb 330 also on the opposite side of doorstop 320 from door latch 430. Second vertical track 150 includes seven second vertical track receptacles 160 evenly distributed along the second vertical track. Second vertical track receptacles 160 are circular in shape but have an opening 161 at the top so that second end 182 of bar 180 can be positioned downward into second vertical track receptacle 160. Second vertical track receptacles 160 have an inner diameter equal to or slightly less than the diameter of bar 180 so that second end 182 of bar 180 can fit within it. Second vertical track receptacle 160 also includes hole 162 that runs horizontally through both sides of second vertical track receptacle 160. Second vertical track 160 also includes five fastening locations 170 so that second vertical track 150 can be secured to door jamb 330. Second vertical track 150 may be secured to door jamb 330 using fasteners known to one skilled in the art such as screws, nails, bolts, or plugs, among others.

When vertical tracks 110 and 150 are attached to their corresponding door jambs 310 and 330 vertical track receptacles 120 and 160 are positioned such that when bar 180 is in place it is horizontal to floor 500. Bar 180 may be secured to the modular fitness system first by inserted first end 181 at a slight angle upward from horizontal direction into first vertical track receptacle 120. Second end 182 of bar 180 may then be inserted in a downward direction in second vertical track receptacle 160. Bar 180 also includes hole 183 proximate to bar second end 182. Hole 183 runs through bar along its diameter and corresponds to holes 162 running through second vertical track receptacles 160. When bar 180 is positioned within the vertical track receptacles, pin 190 can be slide through second vertical track receptacle hole 162 and through bar hole 183 and then secured in place with pin clip 191.

One skilled in the art would recognize suitable dimensions for vertical tracks of the present invention. It would be understood that the vertical height of the track should be suitable to be placed within a doorway. Suitable vertical heights include between about 24 and about 100 inches, preferably between about 36 and about 84 inches. In a preferred embodiment, the vertical height is about 75 inches. The width of the vertical tracks is selected such that the tracks fit in the door jamb on the opposite side of the door stop from side of the door jamb with the door hinges and door latch. It is desirable for the track to not extend past the door jamb to maintain a lower profile for aesthetic and safety reasons. In certain embodiments the width of the vertical tracks may be between about 1 and about 6 inches, preferably between about 1.5 and about 4 inches. In a preferred embodiment, the width is about 2 inches. The vertical tracks may have a thickness of between about 0.1 inches and about 0.5 inches, preferable between about 0.125 inches and about 0.25 inches.

Similarly, to the vertical tracks, the dimensions of the bar are preferably such that it fits within a standard doorway. For example, the length of the bar may be between about 24 and about 84 inches, preferably between about 24 and about 48 inches, more preferably between about 30 and about 36 inches. In other embodiments, the bar may have a length of about 24 inches or about 30 inches, or about 32 or about 36 inches. In other embodiments, the bar may have a length to fit within a double doorway. For example, between about 48 inches, or about 60 inches, or about 72 inches or about 84 inches.

The bar may also have a diameter such that it fits within the width of the vertical tracks. For example, the diameter of the bar may be between about 0.75 inches and about 3 inches, preferably between about 1 inch and about 2 inches. In a preferred embodiment the bar has a diameter of about 1.25 inches. Likewise, the inner diameter of the receptacles maybe slight less than the diameter of the bar. For example, the receptacles may have an inner diameter of between about 0.75 and about 3 inches, preferably between about 1 and about 2 inches. In a preferred embodiment the receptacles have an inner diameter of about 1.25 inches.

The number of receptacles per track may vary depending upon the height of the vertical track and the desired use. In some embodiments, the track has at least one receptacle, in other embodiments, the vertical tracks have 2, or 3, or 4, or 5, or 6, or 7, or greater than 7 receptacles. In a preferred embodiment, the vertical tracks have 7 receptacles. In certain embodiments, the receptacles are evenly distributed along the vertical track. Preferably, the receptacles are distributed about 12 inches apart from the center of each receptacle.

One skilled in the art would understand that the fitness system may be made of various materials suitable for such device. For example, the system or individual components of the system may be made of steel, aluminum, wood, polycarbonate, carbon fiber, titanium, stainless steel, galvanized steel, bronze, copper, or brass. In a preferred embodiment, the tracks are made of steel. In a preferred embodiment, the bar is made of aluminum. In a preferred embodiment, the pin and pin clip are made of aluminum.

It is also understood that although the present invention is described as suitable for placement within a doorway, the fitness system would also be suitable for use within an entryway, archway, or any location wherein the vertical tracks can be secured to vertical studs or posts.

In certain embodiments, the system is in the form of a kit, wherein the kit includes two vertical tracks each vertical track having at least one receptacle and at least one fastening location, a bar having a length corresponding to the width of a doorway, a pin with clip for securing the bar to one of the receptacles and fasteners for securing the vertical tracks to a door jamb.

In a preferred embodiment, the system is in the form of a kit, wherein the kit includes two vertical tracks, each vertical track having seven receptacles and five fastening locations, a bar having length corresponding to the width of a doorway, a pin with a clip for securing the bar to one of the receptacles, and fasteners for securing the vertical tracks to the door jamb.

What is claimed:

1. A fitness system comprising:

a bar having a first end, a second end, and a length;

a first vertical track having a height, a width, and a plurality of first vertical track receptacles for receiving the first end of the bar; and a second vertical track having a height, a width, and a plurality of second vertical track receptacles for receiving the second end of the bar;

wherein the tracks are attachable to opposite door jambs of a doorway;

wherein when first end of the bar is inserted into one of the first vertical track receptacles and the second end of the bar is inserted into one of the second vertical track receptacles, the bar is in a horizontal orientation;

wherein the first end of the bar has a diameter which is the same diameter as the rest of the bar, wherein the first vertical track receptacles are shaped as a full circle, and wherein the first end of the bar is inserted into one of the first vertical track receptacles by fitting the diameter of the first end of the bar within the full circle of the first vertical track receptacle; and wherein the second end of the bar has the same diameter as the first end of the bar, wherein the second vertical track receptacles are circular in shape with an opening at its top, and wherein the second end of the bar is inserted into one of the second vertical track receptacles.

2. The fitness system of claim 1, wherein the diameter of the first end of the bar is between 0.75 in and 3 in.

3. The fitness system of claim 2, wherein the second end of the bar is inserted into the second vertical track receptacle by being positioned downward into the second vertical track receptacle.

4. The fitness system of claim 3, wherein each of the second vertical track receptacles comprises a hole, wherein the second end of the bar comprises a hole corresponding to the holes of the second vertical track receptacles, such that a securing pin is insertable through the holes of the second vertical track receptacles and the hole of the second end of the bar.

* * * * *